US008754823B2

(12) United States Patent
Ohara

(10) Patent No.: US 8,754,823 B2
(45) Date of Patent: Jun. 17, 2014

(54) ANTENNA DEVICE

(75) Inventor: Masahiro Ohara, Fukui (JP)

(73) Assignee: Panasonic Corporation, Osaka (JP)

( * ) Notice: Subject to any disclaimer, the term of this patent is extended or adjusted under 35 U.S.C. 154(b) by 501 days.

(21) Appl. No.: 13/041,886

(22) Filed: Mar. 7, 2011

(65) Prior Publication Data

US 2011/0241957 A1 Oct. 6, 2011

(30) Foreign Application Priority Data

Mar. 30, 2010 (JP) ..... 2010-078348

(51) Int. Cl.
*H01Q 7/08* (2006.01)

(52) U.S. Cl.
USPC ..... 343/788

(58) Field of Classification Search
USPC ..... 343/788, 866, 867, 868
See application file for complete search history.

(56) References Cited

U.S. PATENT DOCUMENTS

| | | | | |
|---|---|---|---|---|
| 7,372,421 | B2 * | 5/2008 | Ohara | 343/788 |
| 2010/0164822 | A1 * | 7/2010 | Iwasaki et al. | 343/788 |

FOREIGN PATENT DOCUMENTS

| | | |
|---|---|---|
| JP | 51-093849 | 8/1976 |
| JP | 2001-102832 | 4/2001 |
| JP | 2005-278130 | 10/2005 |

* cited by examiner

*Primary Examiner* — Robert Karacsony
(74) *Attorney, Agent, or Firm* — Panasonic Patent Center

(57) ABSTRACT

An antenna device includes a core portion made of a magnetic material, and a coil including a conductive wire wound on the core portion. The coil includes a winding portion, and an inductance adjuster portion wound at a larger pitch than the winding portion. The coil has an inductance changing according to a position of the inductance adjuster portion. This antenna device has a resonance frequency which is adjustable in a wide range.

5 Claims, 9 Drawing Sheets

ANTENNA DEVICE

FIELD OF THE INVENTION

The present invention relates to an antenna device with an adjustable resonance frequency.

BACKGROUND OF THE INVENTION

With the recent spread of wireless communications systems for the remote control of the locking/unlocking of vehicle doors, there is a growing demand for inexpensive antenna devices which are securely controlled by vehicle drivers within a predetermined distance from the vehicles.

FIGS. 8 and 9 are perspective views of conventional antenna device 10. Antenna device 10 includes core portion 11 which is made of a square-column-shaped nickel ferrite magnetic material having a magnetic permeability of about 1500. Recess 12 is provided in an upper surface of core portion 11, and extends longitudinally throughout the entire length of the upper surface at substantially its center.

Antenna device 10 further includes coil 13 which is made of coiled copper wire coated with a heat resistant resin such as polyimide. Coil 13 is densely wound on the outer periphery of core portion 11 from the left to the right end of core portion 11.

Antenna device 10 further includes terminal base 14 which is made of a heat resistant resin, such as a liquid crystal polymer or polybutylene terephthalate. Terminal base 14 includes conductive chips 15, 16, 17, and 18, and terminal portions 19 and 20 which are planar and made of, e.g. copper alloy by insert-molding.

An end of the copper wire which forms coil 13 is connected by high-temperature soldering or caulking to an end of conductive chip 15 out of conductive chips 15, 16, 17, and 18 and terminal portions 19 and 20.

Conductive chip 15 and terminal portion 19 are formed unitarily.

The other end of the copper wire which forms coil 13 is connected to one end of conductive chip 16 by high-temperature soldering or caulking.

Conductive chip 17 is formed unitarily with conductive chip 16, and is exposed to terminal base 14.

Conductive chip 18 exposed to terminal base 14 is formed unitarily with terminal portion 20.

Capacitor 21 is mounted by cream soldering or other means onto conductive chips 17 and 18 exposed to terminal base 14.

Core portion 11 is fixedly fitted to terminal base 14 with an adhesive, such as silicon.

Antenna device 10 further includes auxiliary core 22 having a square column shape. Auxiliary core 22 is made of either a manganese ferrite magnetic material having a magnetic permeability of about 4000 or the same nickel ferrite magnetic material as core portion 11. Auxiliary core 22 is inserted into recess 12 from the right end of core portion 11, and is fixed to core portion 11 with an adhesive, such as silicon or a sealant.

FIG. 10 is a circuit diagram of antenna device 10. One end of coil 13 is connected to conductive chip 15 formed unitarily with terminal portion 19. The other end of the coil is connected to conductive chip 16.

Capacitor 21 is connected to conductive chip 17 formed unitarily with conductive chip 16, and to conductive chip 18 formed unitarily with terminal portion 20. Thus, capacitor 21 and coil 13 constitute a series resonant circuit.

In conventional antenna device 10, a resonance frequency of the antenna device is adjusted by movably inserting auxiliary core 22 into recess 12 of core portion 11 of coil 13. Antenna devices which have their resonant frequencies adjustable with an auxiliary core as in antenna device 10 are strongly demanded to reduce costs with their increasing installation rate in vehicles. In this type of antenna devices, the resonance frequency is adjusted within about 2% of the reference resonance frequency in terms of reliability and practicality.

An antenna device similar to conventional antenna device 10 is disclosed in Japanese Patent Unexamined Publication No. 2005-278130.

SUMMARY OF THE INVENTION

An antenna device includes a core portion made of a magnetic material, and a coil including a conductive wire wound on the core portion. The coil includes a winding portion, and an inductance adjuster portion wound at a larger pitch than the winding portion. The coil has an inductance changing according to a position of the inductance adjuster portion.

This antenna device has a resonance frequency which is adjustable in a wide range.

DETAILED DESCRIPTION OF THE INVENTION

Exemplary Embodiment 1

Figure 1:
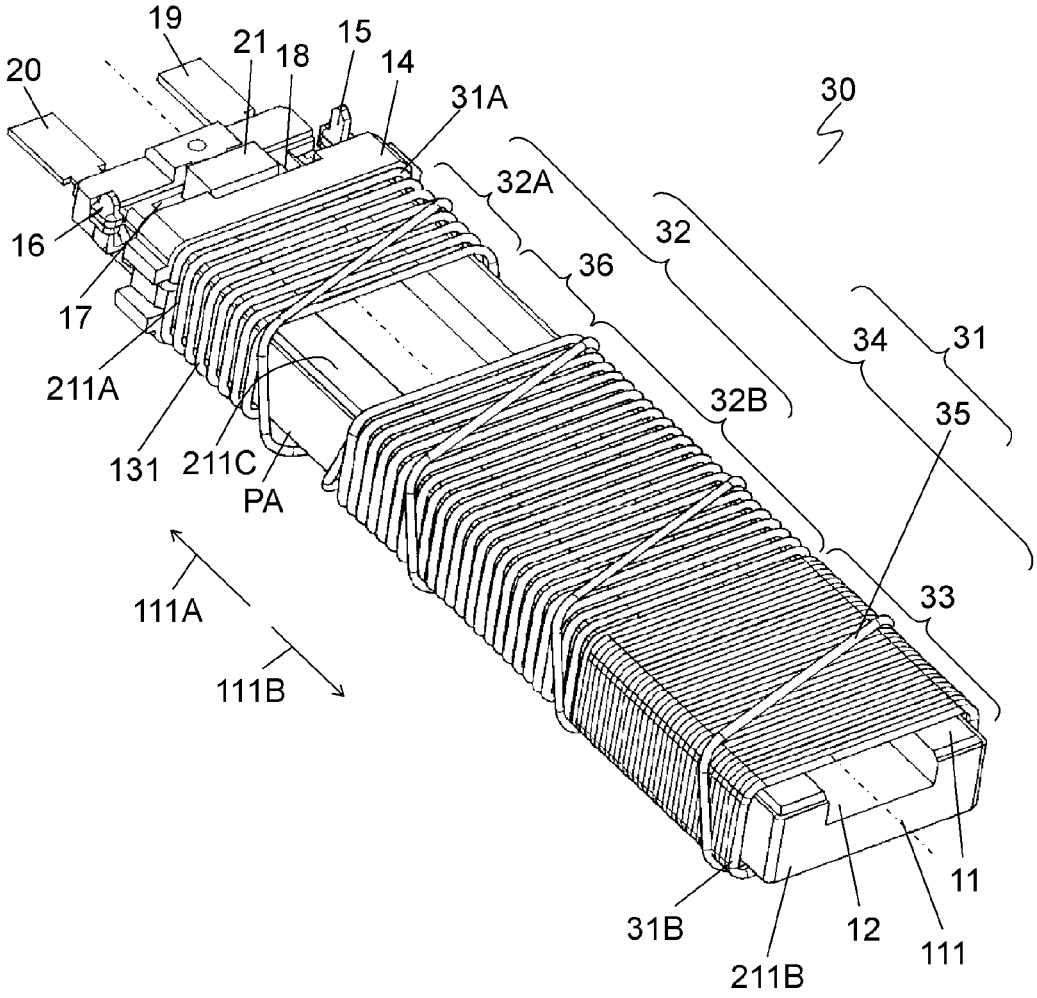
FIG. 1 is a perspective view of an antenna device according to Exemplary Embodiment 1 of the present invention.

FIG. 1 is a perspective view of antenna device 30 according to Exemplary Embodiment 1 of the present invention. Antenna device 30 includes core portion 11 which is made of a nickel ferrite magnetic material having a magnetic permeability of about 1500 and has a square column shape extending along longitudinal axis 111. Core portion 11 has end 211A in direction 111A along longitudinal axis 111, and end 211B in direction 111B opposite to direction 111A. Ends 211B and 211A are positioned opposite to each other. Core portion 11 has side surface 211C which extends between ends 211A and 211B along longitudinal axis 111. Side surface 211C has recess 12 therein extending between ends 211A and 211B along longitudinal axis 111. Recess 12 is positioned substantially in the center of the width of side surface 211C in a direction perpendicular to longitudinal axis 111.

Conductive wire 131 made of, e.g. copper wire coated with a heat resistant resin, such as polyimide is wound on an outer periphery of core portion 11 about longitudinal axis 111 from end 211A toward end 211B of core portion 11, thus providing coil 31. Coil 31 has end portions 31A and 31B which are located at sides of ends 211A and 211B of core portion 11, respectively.

End portion 31A of coil 31 is closer to end 211A of core portion 11 than end portion 31B is. End portion 31B of coil 31 is closer to end 211B of core portion 11 than end portion 31A is.

Antenna device 30 further includes terminal base 14 which is made of a heat resistant resin, such as a liquid crystal polymer or polybutylene terephthalate, and is fixed to end 211A of core portion 11.

Conductive chips 15, 16, 17, and 18, and terminal portions 19 and 20 which are planar and made of, e.g. a copper alloy is fixed to terminal base 14 by insert-molding.

One end of conductive wire 131 which forms coil 31 is connected to one end of conductive chip 15 out of conductive chips 15, 16, 17, and 18, and terminal portions 19 and 20 by high-temperature soldering or caulking.

Conductive chip 15 and terminal portion 19 are formed unitarily.

The other end of conductive wire 131 which forms coil 31 is connected to one end of conductive chip 16 to by high-temperature soldering or caulking.

Conductive chip 17 is formed unitarily with conductive chip 16, and is exposed to terminal base 14.

Conductive chip 18 exposed to terminal base 14 is formed unitarily with terminal portion 20.

Capacitor 21 is mounted by cream soldering or other means onto conductive chips 17 and 18 exposed to terminal base 14.

Coil 31 has a double-layer structure including first winding layer 34 wound on core portion 11, and second winding layer 35 formed on first winding layer 34. First winding layer 34 and second winding layer 35 are connected in series to each other. First winding layer 34 is closer to core portion 11 than second winding layer 35 is. First winding layer 34 of coil 31 is wound from end portion 31A to end portion 31B. Second winding layer 35 is connected to first winding layer 34 at end portion 31B, and wound from end portion 31B to end portion 31A. End portion 31A of coil 31 is located at end 211A of core portion 11. First winding layer 34 includes sparse winding section 32 and dense winding section 33. Sparse winding section 32 extends from end portion 31A toward end portion 31B. Dense winding section 33 extends from sparse winding section 32 to end portion 31B. Sparse winding section 32 and dense winding section 33 are connected in series to each other. Second winding layer 35 is formed of conductive wire 131 wound to end portion 31A from end portion 31B connected to dense winding section 33. Any portion of dense winding section 33 has a smaller pitch than any portion of sparse winding section 32.

Sparse winding section 32 includes winding portion 32A, inductance adjuster portion 36, and winding portion 32B. Winding portion 32A extends from end portion 31A toward end portion 31B. Inductance adjuster portion 36 extends from winding portion 32A toward end portion 31B. Winding portion 32B extends from inductance adjuster portion 36 toward end portion 31B. Winding portion 32A, inductance adjuster portion 36, and winding portion 32B are connected in series. Dense winding section 33 is connected to winding portion 32B, and extends from winding portion 32B to end portion 31B.

Inductance adjuster portion 36 is provided between winding portions 32A and 32B. Changing the position of inductance adjuster portion 36 of sparse winding section 32 can adjust the inductance of coil 31. In antenna device 30, inductance adjuster portion 36 is located at position PA deviating from the center of sparse winding section 32 along directions 111A and 111B in direction 111A approaching end portion 31A. Inductance adjuster portion 36 consists of one turn of conductive wire 131, and has pitch P36 which is larger than pitches P32A and P32B of winding portions 32A and 32B. In Exemplary Embodiment 1, pitches P32A and 32B are equal to each other, and pitch P36 is about two to seven times pitches P32A and 32B. The ratio of pitch P36 to pitch P32A (P32B) is determined according to the range of adjusting the inductance of coil 31. Note that the width and the number of turns of the entire sparse winding section 32 in directions 111A and 111B are not changed.

Winding portion 32A is connected to conductive chip 15 by high-temperature soldering or caulking at end portion 31A of coil 31. One end of second winding layer 35 is connected to conductive chip 16 by high-temperature soldering or caulking at end portion 31A.

Adjusting the position of inductance adjuster portion 36 in sparse winding section 32 results in changing the degree of magnetic coupling and the magnetic flux between core portion 11 and coil 31, thereby adjusting the inductance of coil 31.

In order to reduce a capacitance between first winding layer 34 and second winding layer 35 overlapping each other, second winding layer 35 has pitch P35 which is larger than the pitch of the portion of sparse winding section 32 other than inductance adjuster portion 36, that is, larger than pitches P32A and P32B of winding portions 32A and 32B.

Figure 2:
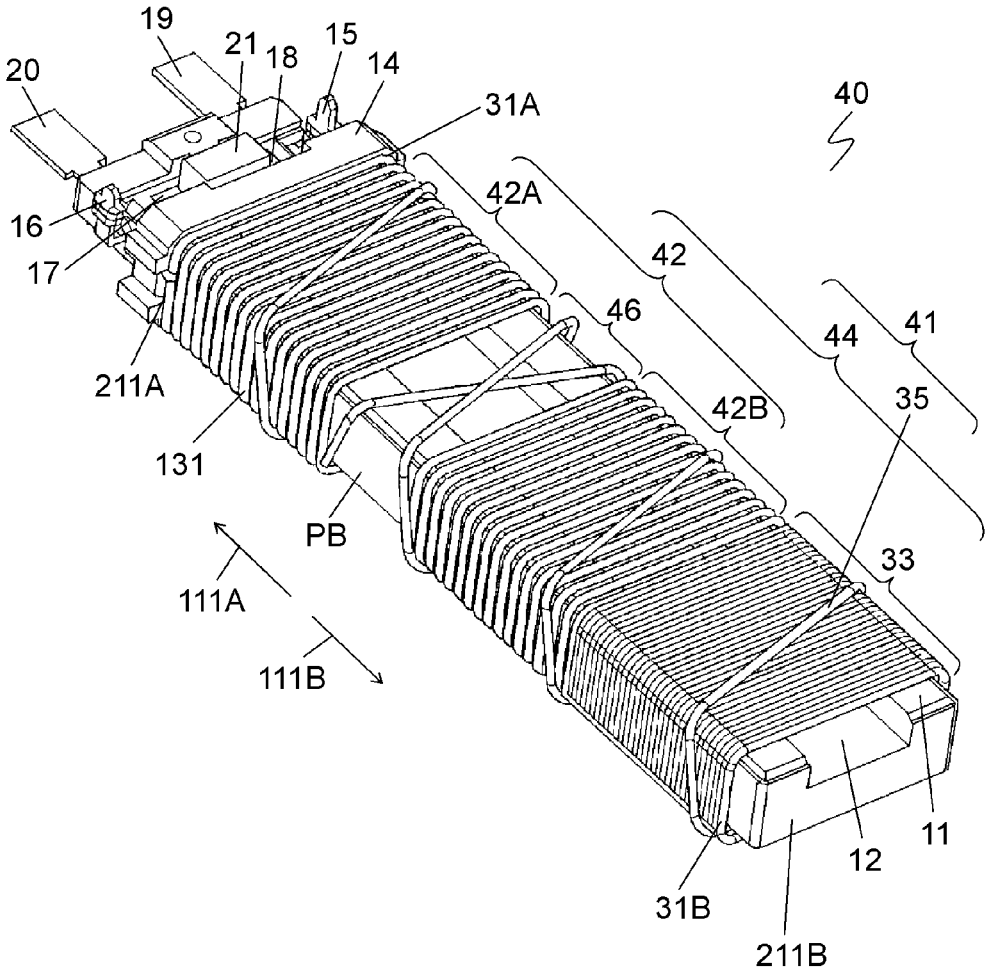
FIG. 2 is a perspective view of another antenna device according to Embodiment 1.

FIG. 2 is a perspective view of another antenna device 40 of Exemplary Embodiment 1. In FIG. 2, components identical to those of antenna device 30 shown in FIG. 1 are denoted by the same reference numerals. Antenna device 40 includes coil 41 instead of coil 31 of antenna device 30 shown in FIG. 1. Coil 41 has a double-layer structure including first winding layer 44 wound on core portion 11, and second winding layer 35 formed on first winding layer 44. First winding layer 44 and second winding layer 35 are connected in series. First winding layer 44 of coil 41 is wound from end portion 31A to end portion 31B. Second winding layer 35 is connected to first winding layer 44 at end portion 31B, and wound from end portion 31B to end portion 31A. End portion 31A of coil 41 is located at end 211A of core portion 11. First winding layer 44 includes sparse winding section 42 and dense winding section 33. Sparse winding section 42 extends from end portion 31A toward end portion 31B. Dense winding section 33 extends from sparse winding section 42 to end portion 31B. Sparse winding section 42 and dense winding section 33 are connected in series. Any portion of dense winding section 33 has a smaller pitch than any portion of sparse winding section 42.

Sparse winding section 42 includes winding portion 42A, inductance adjuster portion 46, and winding portion 42B. Winding portion 42A extends from end portion 31A toward end portion 31B. Inductance adjuster portion 46 extends from winding portion 42A toward end portion 31B. Winding portion 42B extends from inductance adjuster portion 46 toward end portion 31B. Winding portion 42A, inductance adjuster portion 46, and winding portion 42B are connected in series.

Dense winding section 33 is connected to winding portion 42B, and extends from winding portion 42B to end portion 31B.

Thus, inductance adjuster portion 46 is provided between winding portions 42A and 42B. Changing the position of inductance adjuster portion 46 of sparse winding section 42 can adjust the inductance of coil 41. In antenna device 40, inductance adjuster portion 46 is located at position PB, the center of the width of sparse winding section 42 in directions 111A and 111B. Inductance adjuster portion 46 consists of one turn of conductive wire 131, and has pitch P46 which is larger than pitches P42A and P42B of winding portions 42A and 42B. In Exemplary Embodiment 1, pitches P42A and 42B are equal to each other, and pitch P46 is about two to seven times pitches P42A and P42B. The ratio of pitch P46 to pitch P42A (42B) is determined according to the range of adjusting the inductance of coil 41. Note that the width and the number of turns of the entire sparse winding section 42 in directions 111A and 111B are not changed.

Winding portion 42A is connected to conductive chip 15 at end portion 31A of coil 41 by high-temperature soldering or caulking. One end of winding layer 35 is connected to conductive chip 16 at end portion 31A by high-temperature soldering or caulking.

Adjusting the position of inductance adjuster portion 46 in sparse winding section 42 results in changing the degree of magnetic coupling and the magnetic flux between core portion 11 and coil 41, thereby adjusting the inductance of coil 41.

In order to reduce a capacitance between first winding layer 44 and second winding layer overlapping each other, second winding layer 35 has pitch P35 which is larger than the pitch of the portion of sparse winding section 42 of first winding layer 44 other than inductance adjuster portion 46, that is, larger than pitches P42A and P42B of winding portions 42A and 42B.

Figure 3:
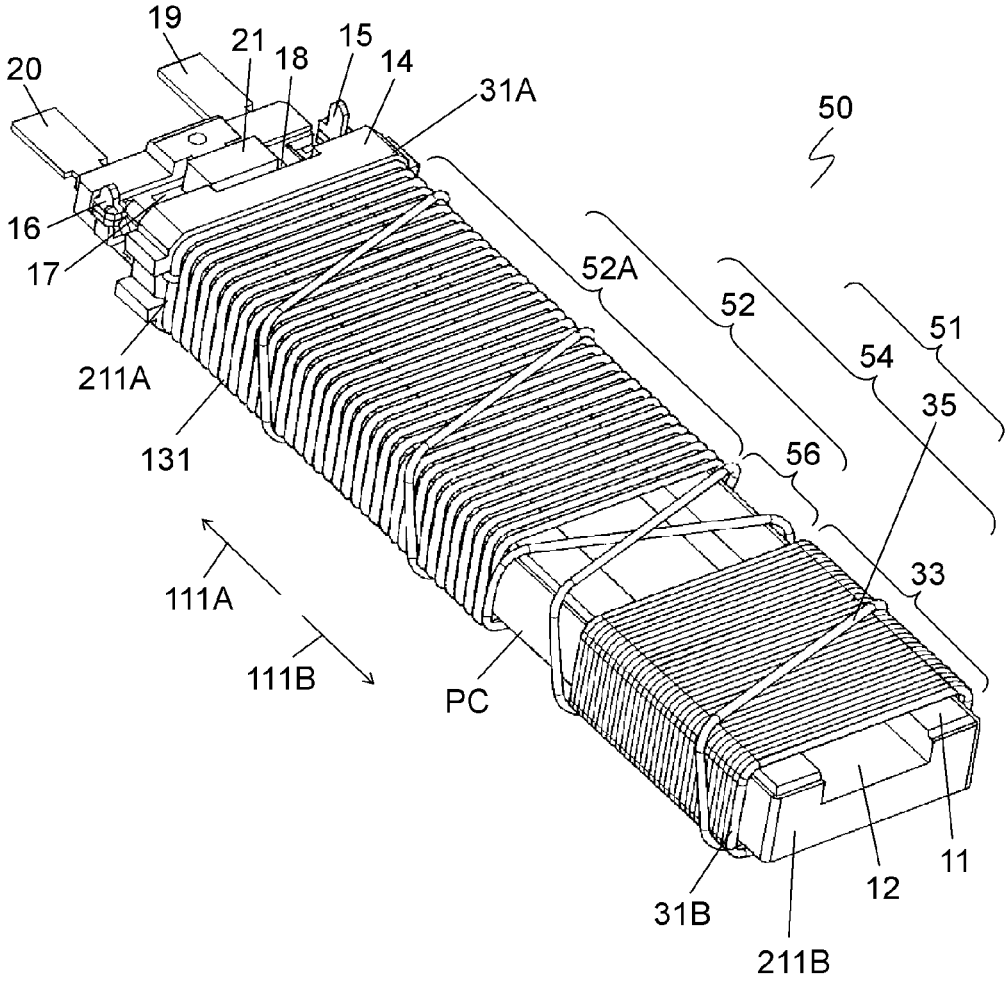
FIG. 3 is a perspective view of still another antenna device according to Embodiment 1.

FIG. 3 is a perspective view of sill another antenna device 50 according to Exemplary Embodiment 1. In FIG. 3, components identical to those of antenna device 30 shown in FIG. 1 are denoted by the same reference numerals. Antenna device 50 includes coil 51 instead of coil 31 of antenna device 30 shown in FIG. 1. Coil 51 has a double-layer structure including first winding layer 54 wound on core portion 11, and second winding layer 35 formed on first winding layer 54. Winding layer 54 and second winding layer 35 are connected in series. First winding layer 54 of coil 51 is wound from end portion 31A to end portion 31B. Second winding layer 35 is connected to first winding layer 54 at end portion 31B, and wound from end portion 31B to end portion 31A. End portion 31A of coil 51 is located at end 211A of core portion 11. First winding layer 54 includes sparse winding section 52 and dense winding section 33. Sparse winding section 52 extends from end portion 31A toward end portion 31B. Dense winding section 33 extends from sparse winding section 52 to end portion 31B. Sparse winding section 52 and dense winding section 33 are connected in series. Any portion of dense winding section 33 has a smaller pitch than any portion of sparse winding section 52.

Sparse winding section 52 includes winding portion 52A and inductance adjuster portion 56. Winding portion 52A extends from end portion 31A toward end portion 31B. Inductance adjuster portion 56 extends from winding portion 52A toward end portion 31B. Winding portion 52A and inductance adjuster portion 56 are connected in series. Dense winding section 33 is connected to inductance adjuster portion 56, and extends from inductance adjuster portion 56 to end portion 31B.

Inductance adjuster portion 56 is provided between winding portion 52A and dense winding section 33. Changing the position of inductance adjuster portion 56 of sparse winding section 52 can adjust the inductance of coil 51. In antenna device 50, inductance adjuster portion 56 consists of one turn of conductive wire 131, and has pitch P56 which is larger than pitch P52A of winding portion 52A of inductance adjuster portion 56. In Exemplary Embodiment, pitch P56 is about two to seven times pitch P52A. The ratio of pitch P56 to pitch P52A is determined according to the range of adjusting the inductance of coil 51. Note that the width and the number of turns of the entire sparse winding section 52 in directions 111A and 111B are not changed.

Winding portion 52A is connected to conductive chip 15 at end portion 31A of coil 51 by high-temperature soldering or caulking. One end of winding layer 35 is connected to conductive chip 16 at end portion 31A by high-temperature soldering or caulking.

Adjusting the position of inductance adjuster portion 56 in sparse winding section 52 results in changing the degree of magnetic coupling and the magnetic flux between core portion 11 and coil 51, thereby adjusting the inductance of coil 51.

In order to reduce a capacitance between first winding layer 54 and second wiring layer 35 overlapping each other, second winding layer 35 has pitch P35 which is larger than the pitch of the portion of sparse winding section 52 other than inductance adjuster portion 56, that is, larger than pitch P52A of winding portion 52A.

Thus, in antenna device 30 shown in FIG. 1, inductance adjuster portion 36 is located at position PA which is in sparse winding section 32 of first winding layer 34 and is close to terminal base 14. In antenna device 40 shown in FIG. 2, inductance adjuster portion 46 is located at position PB which is the center of the winding width of sparse winding section 42 of first winding layer 44 in direction 111A. In antenna device 50 shown in FIG. 3, inductance adjuster portion 56 is located at position PC which is between winding portion 52A and dense winding section 33 of first winding layer 54.

Thus, in each of antenna devices 30, 40, and 50, the inductance adjuster portion is moved from end portion 31A toward end portion 31B within the winding width of the sparse winding section of the first winding layer.

Figure 4:
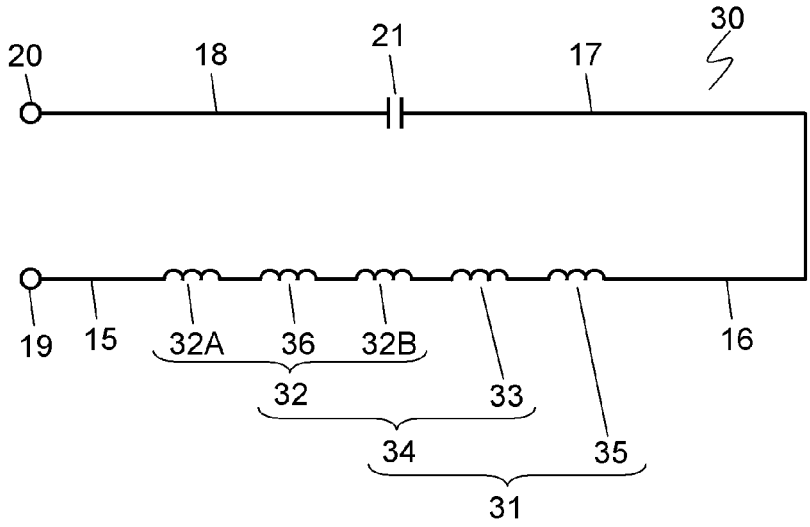
FIG. 4 is a circuit diagram of the antenna device according to Embodiment 1.

FIG. 4 is a circuit diagram of antenna device 30 shown in FIG. 1.

One end of winding portion 32A of sparse winding section 32 of first winding layer 34 of coil 31 is connected to conductive chip 15 formed unitarily with terminal portion 19. One end of second winding layer 35 of coil 31 is connected to conductive chip 16. Conductive chip 17 is formed unitarily with conductive chip 16. Conductive chip 18 is formed unitarily with terminal portion 20. Capacitor 21 is connected between conductive chips 17 and 18. As shown in FIG. 4, in antenna device 30, coil 31 and capacitor 21 together form the series resonant circuit. Similarly, in antenna device 40, coil 41 and capacitor 21 together form a series resonant circuit. Similarly, in antenna device 50, coil 51 and capacitor 21 together form a series resonant circuit.

Figure 5:
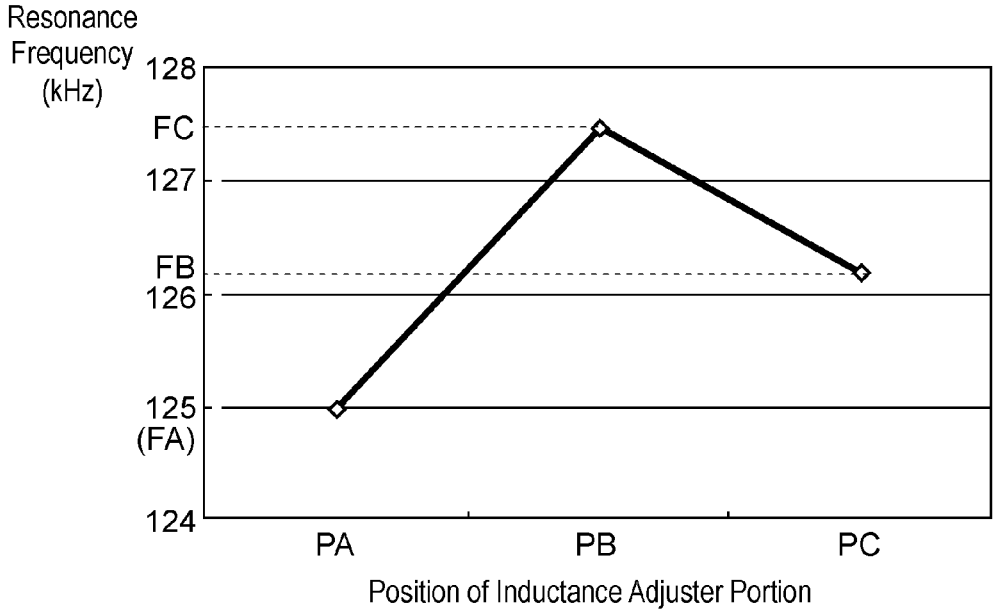
FIG. 5 shows the relation between the resonance frequency and the position of an inductance adjuster portion of a coil of the antenna devices according to Embodiment 1.

FIG. 5 shows the resonant frequencies of antenna devices 30, 40, and 50 in Exemplary Embodiment. In FIG. 5, the horizontal axis represents positions PA, PB, and PC of inductance adjuster portions, and the vertical axis represents the resonant frequencies of the series resonant circuits of antenna devices 30, 40, and 50. Antenna devices 30, 40, and 50 are identical to each other except for the positions of inductance adjuster portions 36, 46, and 56.

As shown in FIG. 5, antenna device 30 including coil 31 having inductance adjuster portion 36 provided at position PA has a resonance frequency FA of 125 kHz. Antenna device 40 including coil 41 having inductance adjuster portion 46 provided at position PB has a resonance frequency FB, which is higher by about 2% than the resonance frequency FA of antenna device 30. Antenna device 50 including coil 51 having inductance adjuster portion 56 provided at position PC has a resonance frequency FC, which is higher by about 1% than the resonance frequency FA. Thus, when the inductance adjuster portion is at position PB which is the center of the winding width of the sparse winding section, the resonance frequency is the highest.

As described above, the resonance frequency can be adjusted by providing inductance adjuster portion 36 at a predetermined position of sparse winding section 32 of first winding layer 34 of coil 31 of antenna device 30.

During actual adjusting of the resonance frequency of antenna device 30 (40, 50), inductance adjuster portion 36 (46, 56) of sparse winding section 32 (42, 52) of first winding layer 34 (44, 54) of the coil is designed based on the conditions, such as the Q value of the antenna device, the variation in the capacity of capacitor 21, and the variation in the material and size of core portion 11.

Figure 6:
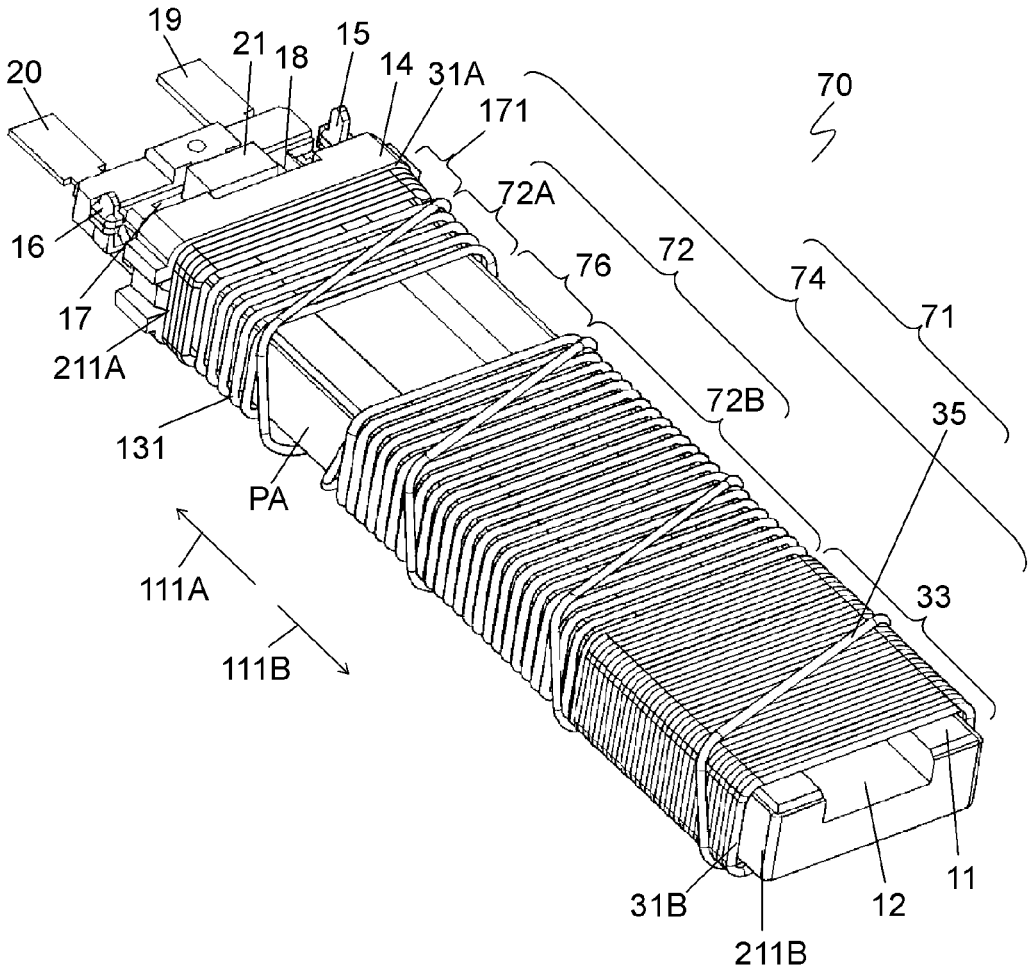
FIG. 6 is a perspective view of a further antenna device according to Embodiment 1.

FIG. 6 is a perspective view of further antenna device 70 of Exemplary Embodiment 1. In FIG. 6, components identical to those of antenna device 30 shown in FIG. 1 are denoted by the same reference numerals. Antenna device 70 includes coil 71 instead of coil 31 of antenna device 30 shown in FIG. 1.

Coil 71 has a double-layer structure including first winding layer 74 wound on core portion 11, and second winding layer 35 formed on first winding layer 74. First winding layer 74 of coil 71 is wound from end portion 31A to end portion 31B. Second winding layer 35 is connected at end portion 31B to first winding layer 74, and wound from end portion 31B to end portion 31A. First winding layer 74 and second winding layer 35 are connected in series. End portion 31A of coil 71 is located at end 211A of core portion 11. First winding layer 74 includes dense winding section 171, sparse winding section 72, and dense winding section 33. Dense winding section 171 extends from end portion 31A toward end portion 31B. Sparse winding section 72 extends from dense winding section 171 toward end portion 31B. Dense winding section 33 extends from sparse winding section 72 to end portion 31B. Dense winding section 171, sparse winding section 72, and dense winding section 33 are connected in series. Second winding layer 35 is formed of conductive wire 131 wound from end portion 31B connected to dense winding section 33 to end portion 31A. Any portion of dense winding sections 33 and 171 has a smaller pitch than any portion of sparse winding section 72.

Sparse winding section 72 includes winding portion 72A, inductance adjuster portion 76, and winding portion 72B. Winding portion 72A extends from dense winding section 171 toward end portion 31B. Inductance adjuster portion 76 extends from winding portion 72A toward end portion 31B. Winding portion 72B extends from inductance adjuster portion 76 toward end portion 31B. Winding portion 72A, inductance adjuster portion 76, and winding portion 72B are connected in series. Dense winding section 33 is connected to winding portion 72B, and extends from winding portion 72B to end portion 31B.

Thus, inductance adjuster portion 76 is provided between winding portions 72A and 72B. Similar to antenna device 30 shown in FIG. 1, changing the position of inductance adjuster portion 76 of sparse winding section 72 can adjust the inductance of coil 71. Inductance adjuster portion 76 consists of one turn of conductive wire 131, and has pitch P76 which is larger than pitches P72A and P72B of winding portions 72A and 72B, respectively. In Exemplary Embodiment 1, pitches P72A and P72B are equal to each other, and pitch P76 is about two to seven times pitches P72A and 72B. The ratio of pitch P76 to pitch P72A (P72B) is determined according to the range of adjusting the inductance of coil 71. Note that the width and the number of turns of the entire sparse winding section 72 in directions 111A and 111B are not changed.

Dense winding section 171 is connected to conductive chip 15 at end portion 31A of coil 71 by high-temperature soldering or caulking. One end of second winding layer 35 is connected to conductive chip 16 at end portion 31A by high-temperature soldering or caulking.

Adjusting the position of inductance adjuster portion 76 in sparse winding section 72 results in changing the degree of magnetic coupling and the magnetic flux between core portion 11 and coil 71, thereby adjusting the inductance of coil 71. Thus, the resonance frequency of antenna device 70 can be adjusted in the same manner as in antenna device 30 shown in FIG. 1.

As described above, antenna device 30 (70) includes core portion 11 made of a magnetic material, and coil 31 (71) including conductive wire 131 wound on core portion 11. Coil 31 (71) includes winding portion 32A (32B, 72A, 72B), and inductance adjuster portion 36 (76) wound at a larger pitch than winding portion 32A (32B, 72A, 72B). Coil 31 (71) has end portion 31A and end portion 31B opposite to end portion 31A. Coil 31 (71) includes sparse winding section 32 (72) including winding portion 32A (32B) and inductance adjuster portion 36 (76), and dense winding section 33 which is located at end portion 31B and which is wound at a smaller pitch than any portion of sparse winding section 32 (72). Coil 71 further includes dense winding section 171 which is located at end portion 31A, and is wound with a smaller pitch than any portion of sparse winding section 72. Inductance adjuster portion 36 consists of one turn of conductive wire 131. Coil 31 (71) includes first winding layer 34 (74) wound on core portion 11, and second winding layer 35 wound on first winding layer 34 (74). First winding layer 34 (74) includes winding portion 32A (32B, 72A, 72B) and inductance adjuster portion 36 (76).

Figure 9:
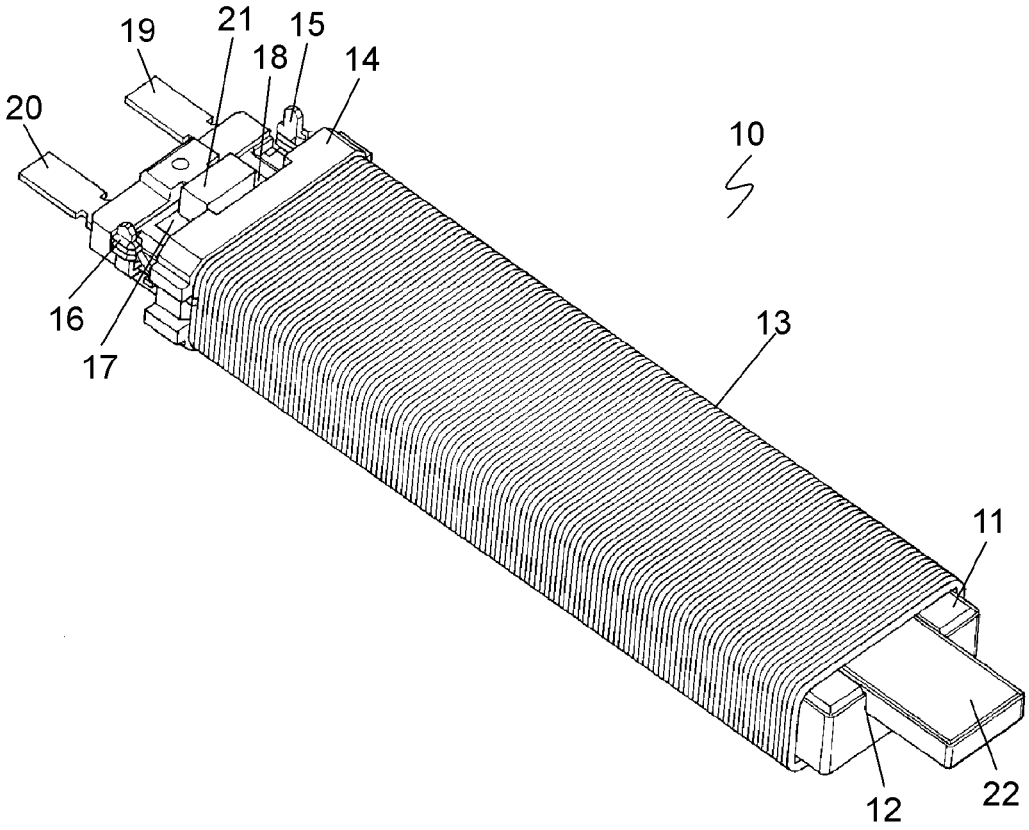
FIG. 9 PRIOR ART
FIG. 9 is a perspective view of the conventional antenna device.
Figure 10:
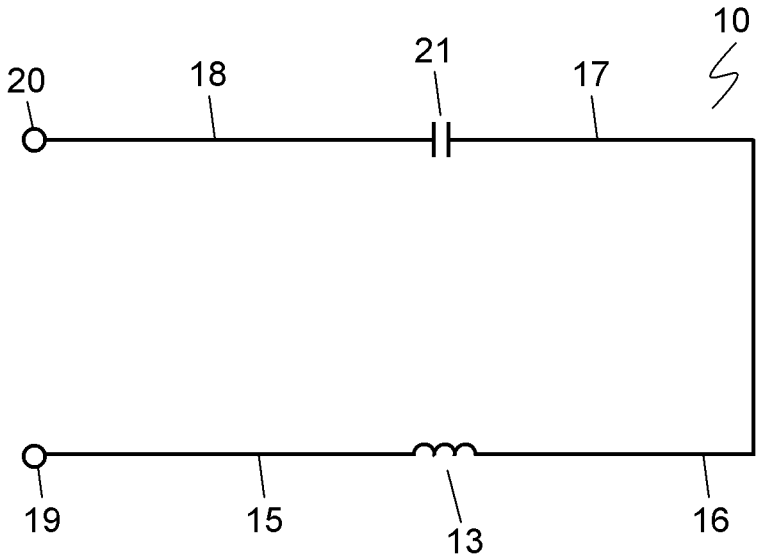
FIG. 10 PRIOR ART
FIG. 10 is a circuit diagram of the conventional antenna device.

The adjusting of the resonance frequency by adjusting the position of inductance adjuster portion 36 (46, 56, 76) is particularly effective to antenna devices having a Q value of not more than 30. In antenna devices 30, 40, 50, and 70 of Exemplary Embodiment 1, the resonance frequency is adjusted without using an auxiliary core equivalent to auxiliary core 22 of conventional antenna device 10 shown in FIG. 9. This eliminates the need to provide such auxiliary core, allowing antenna devices 30, 40, 50, and 70 to be inexpensive and to have a resonance frequency easily adjustable like conventional devices.

In antenna device 30 (40, 50, 70) of Exemplary Embodiment 1, inductance adjuster portion 36 (46, 56, 76) of coil 31 (41, 51, 71) is formed not in dense winding section 33 (171), but in sparse winding section 32 (42, 52, 72). As a result, the resonance frequency of antenna device 30 (40, 50, 70) can be adjusted by adjusting the position of inductance adjuster portion 36 (46, 56, 76) without changing the winding width and the number of turns of coil 31 (41, 51, 71) in direction 111A (111B). This allows antenna device 30 (40, 50, 70) to be inexpensive and to have a resonance frequency as easily adjustable as conventional antenna devices.

Inductance adjuster portion 36 (46, 56, 76) of coil 31 (41, 51, 71) is formed of one turn of conductive wire 131, allowing the resonance frequency to be adjusted stably.

In antenna device 30 (40, 50, 70), coil 31 (41, 51, 71) has a multi-layer (e.g., double-layer) structure including first winding layer 34 (44, 54, 74) and second winding layer 35. Inductance adjuster portion 36 (46, 56, 76) extends within a predetermined range of first winding layer 34 (44, 54, 74). With this structure, the inductance of coil 30 (40, 50, 70) can be adjusted with inductance adjuster portion 36 (46, 56, 76) in close contact with core portion 11. As a result, the magnetic flux can be used efficiently, thereby adjusting the resonance frequency of antenna device 30 (40, 50, 70) stably and accurately.

Exemplary Embodiment 2

Figure 7:
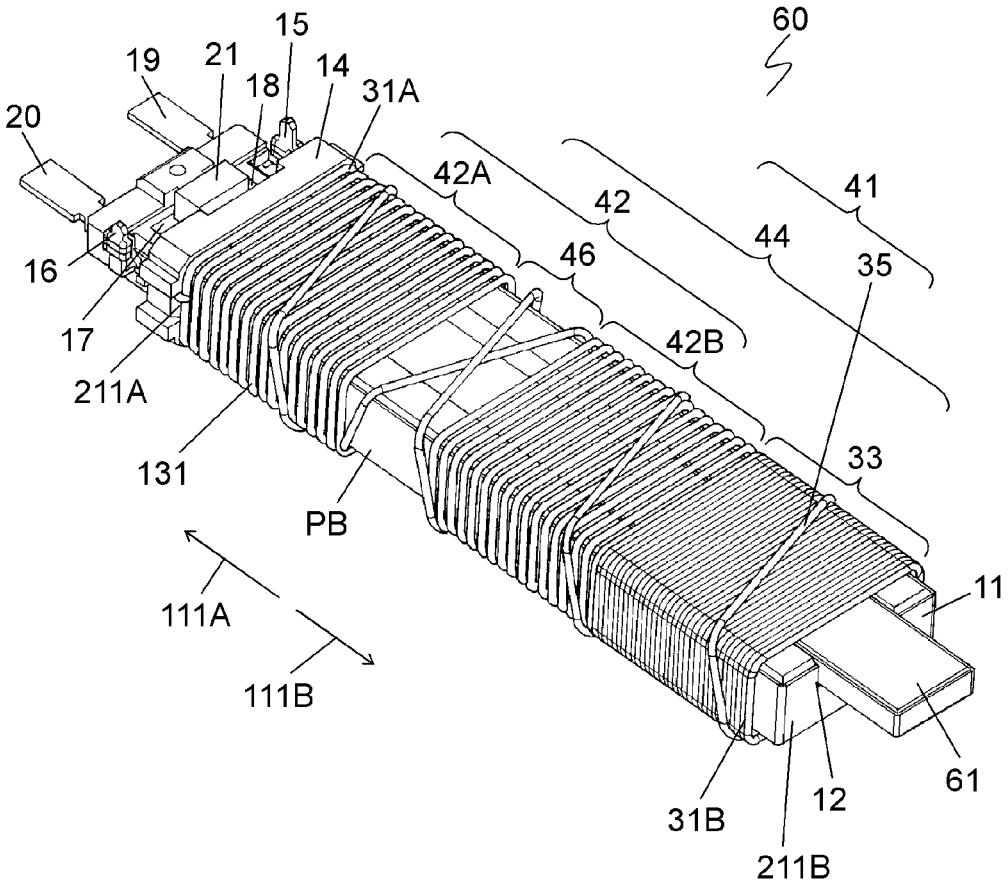
FIG. 7 is a perspective view of an antenna device according to Exemplary Embodiment 2 of the present invention.
Figure 8:
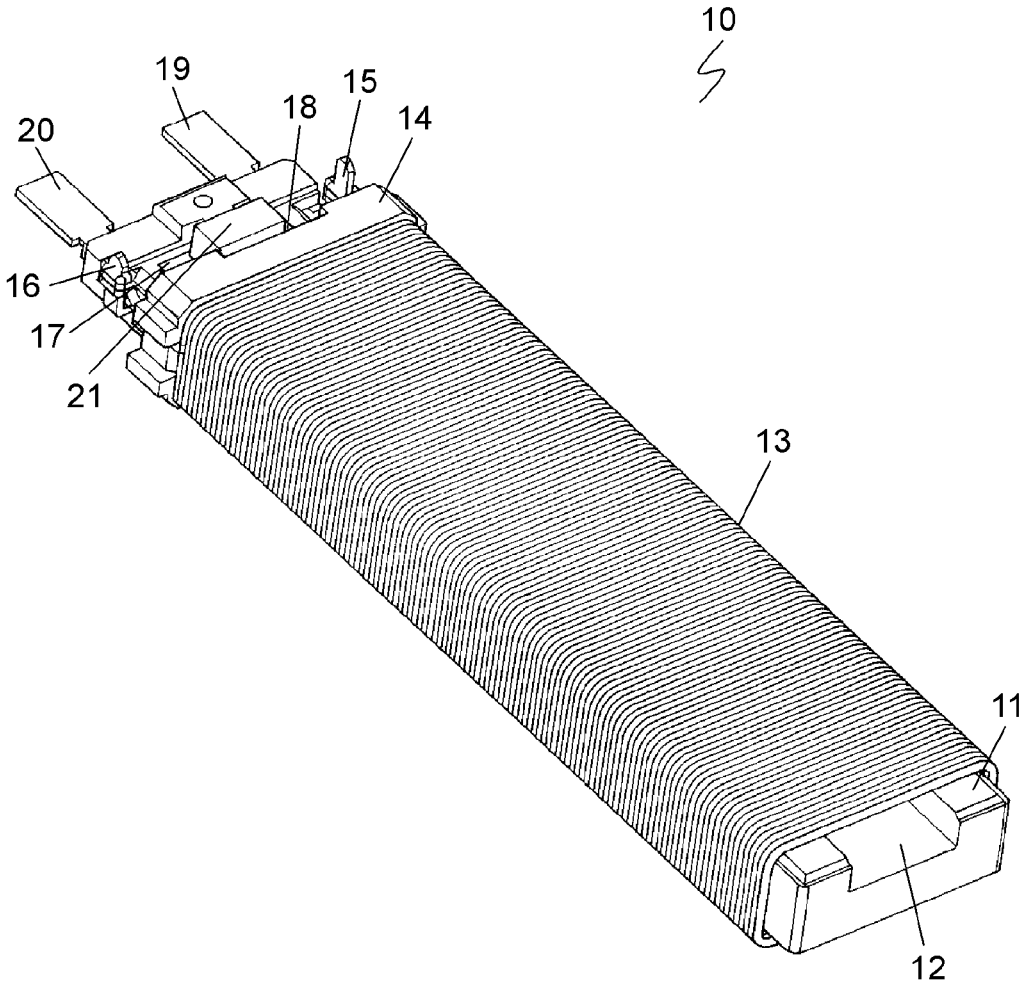
FIG. 8 PRIOR ART
FIG. 8 is a perspective view of a conventional antenna device.

FIG. 7 is a perspective view of antenna device 60 according to Exemplary Embodiment 2 of the present invention. In FIG. 7, components identical to those of antenna device 40 of Exemplary Embodiment 1 shown in FIG. 2 are denoted by the same reference numerals. Antenna device 60 further includes auxiliary core 61 which has a square column shape and is inserted into recess 12 from end 211B of core portion 11. Auxiliary core 61 is fixed in recess 12 with an adhesive such as silicon and a sealant. Auxiliary core 61 is made of either a manganese ferrite magnetic material having a magnetic permeability of about 4000 or the same nickel ferrite magnetic material as core portion 11.

Auxiliary core 61 is inserted into recess 12 of core portion 11 and is movable between core portion 11 and coil 41 and to be positioned at least partially in coil 41. Changing the position of auxiliary core 61 can change the inductance of coil 41, thereby adjusting the resonance frequency of the series resonant circuit formed of coil 41 and capacitor 21. In other words, changing both the position of inductance adjuster portion 46 of coil 41 and the position of auxiliary core 61 can adjust the inductance of coil 41, thereby adjusting the resonance frequency of the series resonant circuit formed of coil 41 and capacitor 21. Therefore, the adjustable range of the resonance frequency is the sum of the range adjusted by changing the position of inductance adjuster portion 46 and the range adjusted by changing the position of auxiliary core 61. In Exemplary Embodiment 2, the resonance frequency can be adjusted in a range not less than 4%, which is much wider than in conventional antenna device 10 in which the resonance frequency is adjusted only by changing the position of auxiliary core 22 shown in FIG. 9.

Thus, in Exemplary Embodiment 2, the coil is provided with an inductance adjuster portion. As a result, a resonance frequency adjustable range similar to that of conventional antenna device 10 which is adjusted by using only an auxiliary core without such auxiliary core. This results in an inexpensive antenna device. In Exemplary Embodiment 2, a combination of changing of the position of the inductance adjuster portion and changing of the position of an auxiliary core allows the antenna device to adjust the resonance frequency in a wider range than conventional antenna device 10. Adjusting the resonance frequency by adjusting the position of an inductance adjuster portion is particularly effective to antenna devices having a Q value not more than 30.

Thus, antenna devices 30 (40, 50, 60, 70) of Exemplary Embodiments 1 and 2 can adjust their resonant frequencies in a wide range, and are useful to vehicle communications systems for the remote control of the locking/unlocking of vehicle doors.

What is claimed is:

1. An antenna device comprising:

a core portion made of a magnetic material; and a coil including a conductive wire wound on the core portion, the coil having a first end portion and a second end portion opposite to the first end portion, wherein the coil including:

a winding portion;

an inductance adjuster portion wound at a larger pitch than the winding portion, the coil having an inductance changing according to a position of the inductance adjuster portion;

a sparse winding section including the winding portion and the inductance adjuster portion; and a first dense winding section provided at the first end portion, the first dense winding section being wound at a smaller pitch than any portion of the sparse winding section.

2. The antenna device of claim 1, wherein the coil further includes a second dense winding section provided at the second end portion, the second dense winding section being wound with a smaller pitch than any portion of the sparse winding section.

3. The antenna device of claim 1, wherein the inductance adjuster portion consists of one turn of the conductive wire.

4. The antenna device of claim 1, wherein the coil includes:

a first winding layer wound on the core portion, the first winding layer including the winding portion and the inductance adjuster portion; and a second winding layer wound on the first winding layer.

5. The antenna device of claim 1, further comprising an auxiliary core positioned at least partially in the coil, the auxiliary core being made of a magnetic material movable with respect to the coil.

* * * * *